US008503902B2

(12) United States Patent
Alkins et al.

(10) Patent No.: US 8,503,902 B2
(45) Date of Patent: Aug. 6, 2013

(54) ELECTROPHOTOGRAPHIC PRINTER WITH CHARGING-ROLLER CLEANER

(75) Inventors: James N. Alkins, Holley, NY (US); Jeffrey Allan Pitas, Macedon, NY (US); Young No, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 279 days.

(21) Appl. No.: 13/097,118

(22) Filed: Apr. 29, 2011

(65) Prior Publication Data

US 2012/0275814 A1 Nov. 1, 2012

(51) Int. Cl.
*G03G 15/02* (2006.01)

(52) U.S. Cl.
USPC ..... 399/100; 399/50; 399/115; 399/168; 399/174; 399/176

(58) Field of Classification Search
USPC ..... 399/50, 115, 100, 168, 174, 176
See application file for complete search history.

(56) References Cited

U.S. PATENT DOCUMENTS

| | | | | |
|---|---|---|---|---|
| 4,339,195 | A * | 7/1982 | Gabelman | 399/100 |
| 5,873,019 | A | 2/1999 | Mizuishi | |
| 5,970,302 | A * | 10/1999 | Yamane | 399/343 |
| 6,608,641 | B1 | 8/2003 | Alexandrovich et al. | |
| 6,836,630 | B2 | 12/2004 | Owen et al. | |
| 6,847,797 | B2 * | 1/2005 | Nishihama et al. | 399/174 |
| 6,996,356 | B2 * | 2/2006 | Atsumi | 399/129 |
| 7,298,993 | B2 * | 11/2007 | Lee et al. | 399/176 |
| 7,454,154 | B2 | 11/2008 | Matsumoto | |
| 7,480,474 | B2 * | 1/2009 | Muto | 399/175 |
| 7,616,913 | B2 | 11/2009 | Matsui et al. | |
| 7,630,664 | B2 | 12/2009 | Ozawa et al. | |
| 8,005,402 | B2 * | 8/2011 | Watanabe et al. | 399/174 |
| 2003/0228172 | A1 * | 12/2003 | Nakamura et al. | 399/174 |
| 2004/0005175 | A1 * | 1/2004 | Lee | 399/313 |
| 2005/0095035 | A1 * | 5/2005 | Vejtasa et al. | 399/168 |
| 2006/0133870 | A1 | 6/2006 | Ng et al. | |
| 2008/0166154 | A1 * | 7/2008 | Watanabe et al. | 399/174 |
| 2009/0162092 | A1 | 6/2009 | Hoshio | |

FOREIGN PATENT DOCUMENTS

JP 10097117 A * 4/1998

* cited by examiner

*Primary Examiner* — David Gray
*Assistant Examiner* — Francis Gray
(74) *Attorney, Agent, or Firm* — Christopher J. White

(57) ABSTRACT

An electrophotographic printer includes a rotatable member and a carriage rotatable around an axis. Two rotatable chargers are mounted on the carriage, each for charging the rotatable member. A carriage drive rotates the carriage to bring the first charger into contact with the rotatable member and the second charger into operative arrangement with a cleaner, or vice versa. A charger drive rotates the charger in operative arrangement with the cleaner at a speed greater than a selected speed or with a torque greater than a selected torque, and the rotatable member rotates the rotatable charger in contact therewith at the selected speed with the selected torque.

14 Claims, 5 Drawing Sheets

ELECTROPHOTOGRAPHIC PRINTER WITH CHARGING-ROLLER CLEANER

FIELD OF THE INVENTION

This invention pertains to the field of electrophotographic printing and more particularly to cleaning roller chargers in a printer.

BACKGROUND OF THE INVENTION

Electrophotographic (EP) printers are useful for producing printed images of a wide range of types. Printers print on receivers (or "imaging substrates"), such as pieces or sheets of paper or other planar media, glass, fabric, metal, or other objects. In the EP process, a photoreceptor is uniformly charged and imagewise discharged. Electrified charging rollers ("roller chargers") are commonly used to charge the photoreceptor, e.g., as discussed in U.S. Pat. No. 7,454,154 to Matsumoto et al. However, toner, paper fibers, and other contaminants can adhere to the photoreceptor and transfer to the roller charger. Over time, these contaminants can reduce the effectiveness with which the roller charges the photoreceptor, or cause non-uniform charging of the photoreceptor, thereby reducing image quality.

Some printers use electrical bias to drive charged contaminants off a roller charger. For example, the CANON M50 printer reverse-biases the charge rollers to drive contaminants onto the photoreceptor, from which they are cleaned by a photoreceptor cleaner. Other schemes include the charger roller as part of a customer-replaceable unit in a printer. The roller is not cleaned, so the customer must replace the unit when the roller contamination reaches unacceptable levels.

Cleaning blades or skives are sometimes used to clean members in EP printers. However, many roller chargers are foam, fur, or another member with a non-rigid surface. For example, U.S. Pat. No. 7,630,664 to Ozawa et al. describes a charging roller with an elastic outer layer. Such compliant or textured roller surfaces are not cleaned effectively by blades. Furthermore, hard-surfaced roller chargers can be damaged by blade cleaners if contaminants become lodged between the blade and the roller. Also, cleaning can produce mechanical wear on a charging roller, and it is desirable to reduce wear to increase the useful life of the roller charger. Similar wear on other components of a printer is described in U.S. Pat. No. 6,836,630 to Owen et al. Additionally, compliant cleaning elements can themselves be deformed or damaged during cleaning. Ozawa '664 describes a compliant cleaning element movable between a more-compressed position and a less-compressed position. However, this scheme is not particularly useful for compliant charge rollers. U.S. Pat. No. 5,873,019 to Mizuishi describes cleaning and disengaging a roller charger. However, this scheme can reduce throughput, since printing cannot be performed while the charger is disengaged.

There is, therefore, an ongoing need for an improved cleaning apparatus for a roller charger that cleans effectively without reducing throughput and without requiring regular replacement.

SUMMARY OF THE INVENTION

According to an aspect of the present invention, there is provided an electrophotographic printer, comprising:

a. a rotatable member;

b. a carriage rotatable around an axis;

c. first and second rotatable chargers mounted on the carriage, each adapted to selectively impart charge to a charge-bearing layer of the rotatable member;

d. a cleaner adapted to selectively remove contaminants from the surface of either of the chargers;

e. a carriage drive adapted to rotate the carriage to bring the first charger into contact with the rotatable member and the second charger into operative arrangement with the cleaner in a first position of the carriage, and to bring the second charger into contact with the rotatable member and the first charger into operative arrangement with the cleaner in a second position of the carriage; and f. a charger drive adapted to selectively rotate the charger in operative arrangement with the cleaner at a speed greater than a selected speed or with a torque greater than a selected torque;

g. wherein the rotatable member rotates the rotatable charger in contact therewith at the selected speed with the selected torque.

According to another aspect of the present invention, there is provided an electrophotographic printer, comprising:

a. a rotatable member;

b. a carriage rotatable around an axis;

c. first and second rotatable chargers mounted on the carriage, each operative to selectively impart charge to a charge-bearing layer of the rotatable member;

d. a cleaner adapted to selectively remove contaminants from the surface of one of the chargers;

e. a carriage drive adapted to move the carriage to bring the first or second charger into contact with the rotatable member in a first position of the carriage, and the first and second chargers into operative arrangement with the cleaner in a second position of the carriage; and f. a drive adapted to selectively rotate each charger in operative arrangement with the cleaner at a speed greater than a selected speed or with a torque greater than a selected torque;

g. wherein the rotatable member rotates the rotatable charger in contact therewith at the selected speed and torque.

According to another aspect of the present invention, there is provided an electrophotographic printer, comprising:

a. a rotatable member;

b. a carriage rotatable around an axis;

c. first and second rotatable chargers mounted on the carriage, each operative to selectively impart charge to a charge-bearing layer of the rotatable member;

d. a cleaner adapted to selectively remove contaminants from the surface of one of the chargers;

e. a carriage drive adapted to rotate the carriage to bring the first charger into contact with the rotatable member and the second charger out of operative arrangement with the cleaner in a first position of the carriage, and the first charger out of contact with the rotatable member and the second charger into operative arrangement with the cleaner in a second position of the carriage;

f. a drive adapted to selectively rotate the charger in operative arrangement with the cleaner at a speed greater than a selected speed or with a respective torque greater than a selected torque; and g. wherein the rotatable member rotates the rotatable charger in contact therewith at the selected speed and torque.

According to another aspect of the present invention, there is provided an electrophotographic printer, comprising:

a. a rotatable member;

b. a carriage;

c. a rotatable charger mounted on the carriage and adapted to selectively impart charge to a charge-bearing layer of the rotatable member;

d. a cleaner adapted to selectively remove contaminants from the surface of the charger;

e. a carriage drive adapted to move the carriage to bring the charger into contact with the rotatable member in a first position of the carriage, and to bring the charger into operative arrangement with the cleaner in a second position of the carriage;

f. a charger drive adapted to selectively rotate the charger at a speed greater than a selected speed or with a torque greater than a selected torque while the charger is in operative arrangement with the cleaner; and g. wherein the rotatable member rotates the rotatable charger in contact therewith at the selected speed with the selected torque.

According to another aspect of the present invention, there is provided an electrophotographic printer, comprising:

a. a rotatable member;

b. a carriage;

c. a rotatable charger mounted on the carriage and adapted to selectively impart charge to a charge-bearing layer of the rotatable member;

d. a rotatable cleaner adapted to selectively remove contaminants from the surface of the charger;

e. a carriage drive adapted to move the carriage to bring the charger into contact with the rotatable member in a first position of the carriage, and to bring the charger into operative arrangement with the cleaner in a second position of the carriage;

f. a cleaner drive adapted to selectively rotate the cleaner in operative arrangement with the charger;

g. a charger drive adapted to selectively rotate the charger in operative arrangement with the cleaner; and h. a controller adapted to cause the cleaner drive to rotate the cleaner, and to cause the charger drive to rotate the charger, so that the relative angular velocity of the cleaner with respect to the charger in operative arrangement with the cleaner is higher in magnitude than a selected angular velocity, and for causing the rotatable member to rotate the charger in contact therewith at the selected angular velocity.

An advantage of this invention is that it provides multiple charger rollers to distribute wear and reduce the need for charge roller replacement. Rollers being cleaned are actively driven to provide good cleaning performance and to permit control of the speed and force to reduce the probability of damaging the rollers during cleaning. Cleaning charge rollers more frequently extends the life of the charge rollers and improves charging uniformity of a photoreceptor. Driving the rollers actively while cleaning, rather than passively using the photoreceptor, reduces the probability of damage to the photoreceptor and enables more frequent cleaning. Various embodiments provide relatively low-friction contact between the photoreceptor and the charging roller by idling the charging roller against the photoreceptor. This also reduces the probability that the charging roller will drag a contaminant against the surface of the photoreceptor and scratch the photoreceptor.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
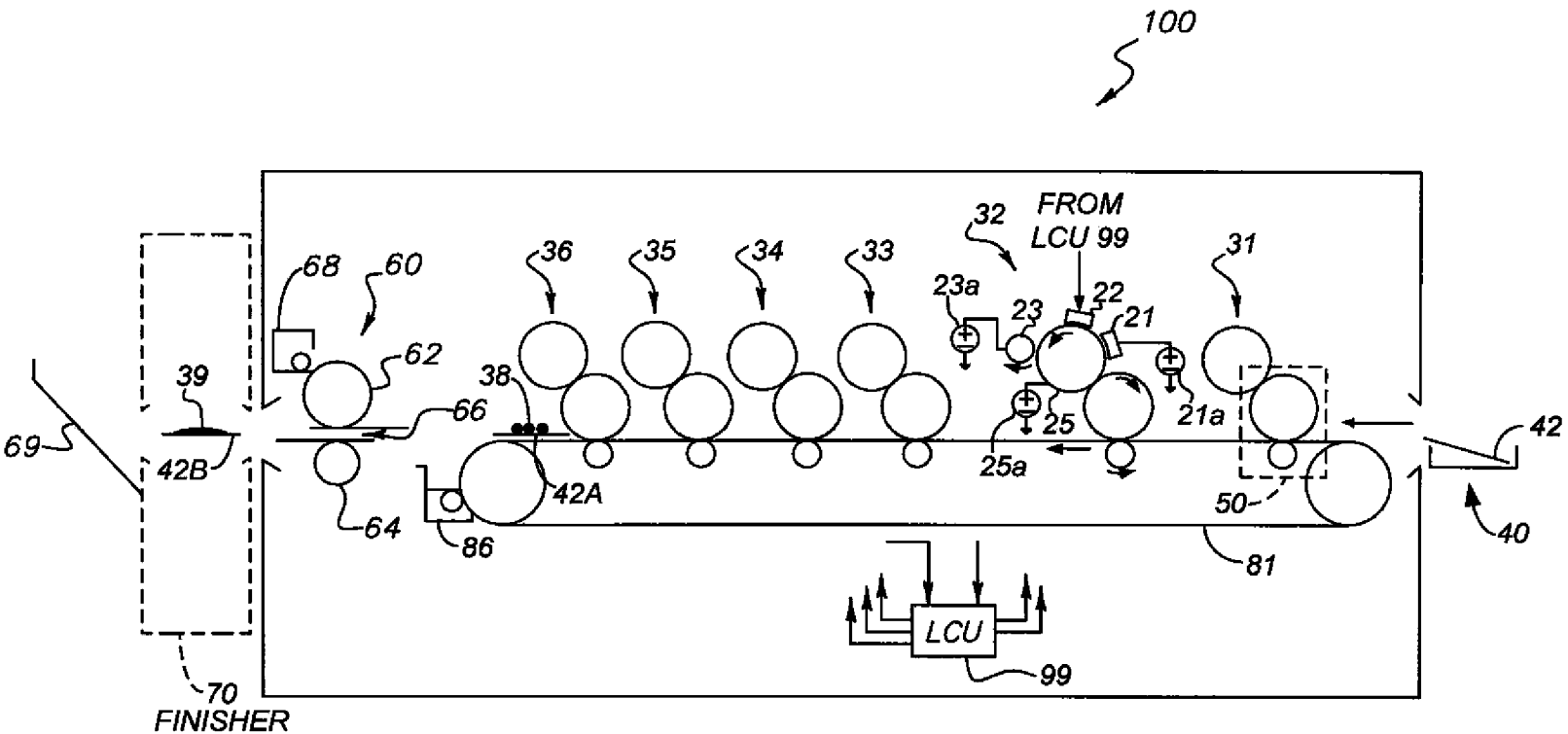
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

The electrophotographic (EP) printing process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. One embodiment of the invention involves printing using an electrophotographic print engine having six sets of single-color image-producing or -printing stations or modules arranged in tandem, but more or fewer than six colors can be combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and toning station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image may not be visible to the naked eye depending on the composition of the toner particles (e.g. clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. In transfer subsystem 50, a suitable electric field is applied to transfer the toner particles of the visible image to receiver 42 to form the desired print image 38 on the receiver, as shown on receiver 42A. The imaging process is typically repeated many times with reusable photoreceptors 25.

The receiver 42A is then removed from its operative association with the photoreceptor 25 and subjected to heat or pressure to permanently fix ("fuse") the print image 38 to the receiver 42A. Plural print images, e.g. of separations of different colors, are overlaid on one receiver before fusing to form a multi-color print image 38 on the receiver 42A.

Each receiver, during a single pass through the six printing modules, can have transferred in registration thereto up to six single-color toner images to form a pentachrome image. As used herein, the term "hexachrome" implies that in a print image, several of the six colors are combined to form other colors on receiver 42 at various locations on receiver 42. That is, each of the six colors of toner can be combined with toner of one or more of the other colors at a particular location on the receiver 42 to form a color different than the colors of the toners combined at that location. In an embodiment, printing module 31 forms black (K) print images, 32 forms yellow (Y) print images, 33 forms magenta (M) print images, 34 forms cyan (C) print images, 35 forms light-black (Lk) images, and 36 forms clear images.

In various embodiments, printing module 36 forms print image 38 using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white. light.

Receiver 42A is shown after passing through printing module 36. Print image 38 on receiver 42A includes unfused toner particles.

Subsequent to transfer of the respective print images, overlaid in registration, one from each of the respective printing modules 31, 32, 33, 34, 35, 36, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g., receiver 42B) carrying the fused image (e.g., fused image 39) are transported in a series from the fuser 60 along a path either to a remote output tray 69, or back to printing modules 31, 32, 33, 34, 35, 36 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 20060133870, published on Jun. 22, 2006, by Yee S. Ng et al., the disclosures of which are incorporated herein by reference.

Figure 2:
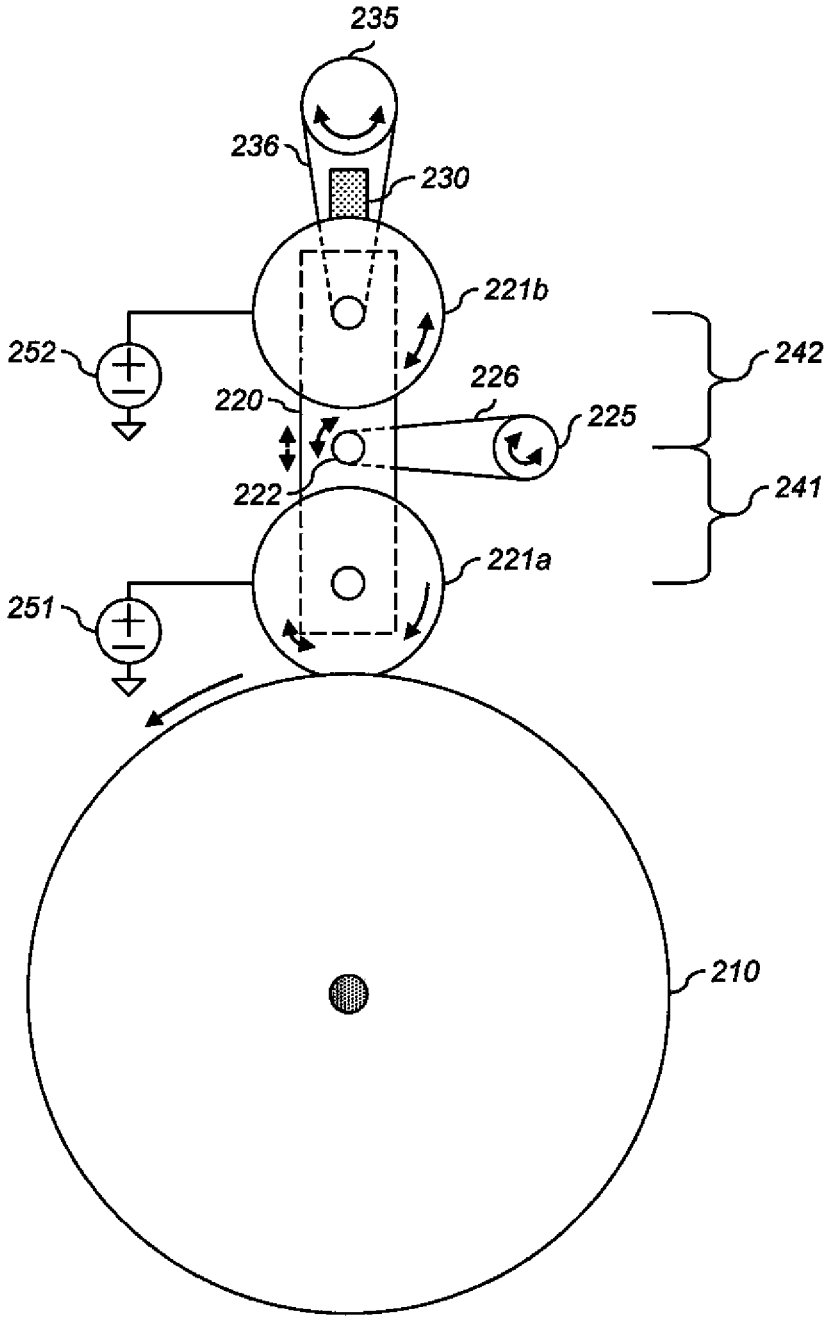
FIGS. 2-5 show components of an EP printer according to various embodiments.

FIG. 2 shows portions of an electrophotographic printer according to various embodiments. Rotatable member 210 can be a photoreceptor (e.g., photoreceptor 25, FIG. 1), an image transport roller that conveys the image from one area within the photocopier to another (e.g., transfer subsystem 50 in FIG. 1), or another rotatable member, either belt or drum. Transport rollers or other rotatable members can include fuser rollers or belts, receiver transport belts, intermediate transfer members, and primary imaging members in addition to photoreceptive members.

Carriage 220 is disposed in proximity to rotatable member 210 and is rotatable around axis 222. First and second rotatable chargers 221*a*, 221*b* are mounted on carriage 220. Each charger 221*a*, 221*b* is adapted to selectively impart charge to a charge-bearing layer of rotatable member 210. A power supply applies an AC, DC, or AC+DC bias to the charger (e.g., charger 221*a*) in contact with rotatable member 210. Since the surface of rotatable member 210 is substantially non-conductive, this applied voltage induces charge in that surface.

Cleaner 230 is adapted to selectively remove contaminants from the surface of either of the chargers 221*a*, 221*b*. In various embodiments, cleaner 230 is or includes a blade (more or less compliant), wiper, roller, foam roller, fur brush, magnetic brush, vacuum or vacuum brush, or skive. Cleaner 230 can be conductive (electronically or ionically) or non-conductive (e.g., a conductive fur brush can be used).

Carriage drive 225 is adapted to rotate carriage 220 by rotating axis 222 using belt 226. Carriage drive 225 can be a motor, servo, linear or rotary actuator, or other active moving device. Carriage drive 225 rotates carriage 220 between a first position and a second position of carriage 220. In the first position, first charger 221*a* is brought into mechanical contact at one or more points with rotatable member 210. Second charger 221*b* is brought into operative arrangement with cleaner 230 so that second charger 221*b* can be cleaned of toner, carrier particles, paper fibers, or other dirt or contamination it accumulates during operation. In the second position (not shown) of carriage 220, second charger 221*b* is brought into contact with rotatable member 210, and first charger 221*a* is brought into operative arrangement with cleaner 230. In this way, rotatable member 210 can be charged by one of the chargers 221*a*, 221*b* while the other charger 221*b*, 221*a* is being cleaned and readied to further charge rotatable member 210. The first position of carriage 220 is shown in FIG. 2, and is used as an example. When the carriage is in the second position, the following discussion applies, but with the roles of chargers 221*a*, 221*b* reversed.

Rotatable member 210 rotates the rotatable charger (e.g., 221*b*) in contact therewith. That is, charger 221*a* (for example) idles against rotatable member 210 and is driven by friction with rotatable member 210 at a selected speed (e.g., magnitude of angular velocity) with a selected torque. This provides force transfer with no overdrive or underdrive. Charger drive 235 is adapted to selectively rotate the charger (e.g., 221*b*) that is in operative arrangement with cleaner 230.

Charger drive 235 is coupled to charger 221*b* through belt 236 and a selectively-engageable coupling such as a clutch or transmission. In other embodiments, charger drive 235 includes a drive gear and chargers 221*a*, 221*b* include respective driven gears. These gears are brought into mesh when carriage 220 rotates, and belt 236 is not used. In other embodiments, charger drive 235 includes a friction drive at the interface between charger drive 235 and charger 221*b* (or 221*a*). The gear ratio of the friction drive is selected to provide a desired rotational speed and torque for cleaning. Belt drive, tooth belt drives, engagement wheels, cable drives, and screw drives can also be used. The coupling (not shown) permits carriage 220 to rotate, and transmits power to whichever charger is in operative arrangement with cleaner 230. That charger (221*a* or 221*b*) is rotated at a speed greater than the selected speed or with a torque greater than the selected torque. This advantageously provides more efficient cleaning than attempting to clean the same charger (221*a* or 221*b*) while it idles against rotatable member 210.

The charger in contact with rotatable member 210 (e.g., charger 221*a*) is driven by friction with rotatable member 210 as the latter rotates. Cleaning charger 221*a* while it was in contact with rotatable member 210 would increase the friction forces on the latter and increase the probability of causing charger 221*a* to slide across the surface of rotatable member 210 rather than rotating with it. Such sliding can result in scratching of, e.g., an organic photoreceptor layer on rotatable member 210. Withdrawing charger 221*a* from rotatable member 210 before cleaning reduces the probability of these problems. Cleaning can also be performed faster and more efficiently when under control of a dedicated motor (charger drive 235), and cleaning parameters (e.g., motion profiles) can be varied independently of charging parameters.

In various embodiments, chargers 221*a*, 221*b* are mounted on carriage 220 at the same distance from the axis thereof. In FIG. 2, these are distances 241, 242 respectively. In various embodiments, carriage 220 can selectively be moved closer to, or farther from, rotatable member 210.

In various embodiments, first and second bias sources 251, 252 selectively provide respective biases. Either bias source 251, 252 can be a DC source, an AC source, or a ground or chassis connection. First bias source 251 provides the first bias to the charger in contact with rotatable member 210 (e.g., charger 221*a*). Second bias source 252 provides the second bias to the charger in operative association with cleaner 230 (e.g., charger 221*b*). First and second bias sources 251, 252 are connected through pogo pins or other connectors (not shown) to permit carriage 220 to rotate. In various embodiments, the magnitude of the first bias with respect to ground is less than or equal to 1 kV while charging rotatable member 210. Photoreceptor 25 can include a conductive layer, or "Q-layer," that can be grounded or driven at a selected potential.

In an example, first bias source 251 provides a positive bias to charger 221*a*. As a result, negatively-charged contaminants can be attracted to charger 221*a* by Lorentz forces. When charger 221*a* rotates into operative arrangement with cleaner 230, second bias source 252 applies a negative bias to repel the negatively-charged contaminants from the surface of charger 221*a*.

In various embodiments, the respective biases provided by first and second bias sources 251, 252 are opposite in sign. This provides the advantages described in the previous paragraph. It also extends the life of ionic charger rollers. In ionic charger rollers, charge is carried to rotatable member 210 by ionic molecules or compounds mixed in to the material of the charger roller. The bias voltage between rotatable member 210 and the voltage source in a charger (e.g., charger 221*a*) in contact therewith exerts a Lorentz force on the ionic molecules. This force can, over time, dislodge the ionic molecules from their places in charger 221*a* and cause them to concentrate either close to rotatable member 210 or far from it. When the ionic molecules concentrate, large gaps are created between ionic molecules and one or the other electrode (rotatable member 210 or the bias source driving charger 221*a*). This increases the voltage required to jump charge across the gaps between ionic molecules and reduces charging efficiency. When the second bias from bias source 252 is opposite in sign to the first bias from bias source 251, Lorentz forces are exerted on the ionic molecules in the opposite direction from the forces exerted on them during charging. The second bias can therefore partially or wholly undo motion induced by the first bias, and vice versa.

In various embodiments, carriage 220 is rotated every job, every print (e.g., every page), every n jobs, n>1, every n pages, after a selected time of operation of the printer, or after a selected time of rotation of the charger 221, 221*b*. In an embodiment, chargers 221, 221*b* are cleaned before significant contamination is deposited on them. In various embodiments, chargers 221*a*, 221*b* are fur rollers, or include carbon particles. In various embodiments, cleaner 230 includes a fur brush, optionally grounded. In various embodiments, carriage 220 can also translate, or can rotate about other axes than that of axis 222 (i.e., can pitch or yaw). This permits easier access to printer components for service.

Figure 3:
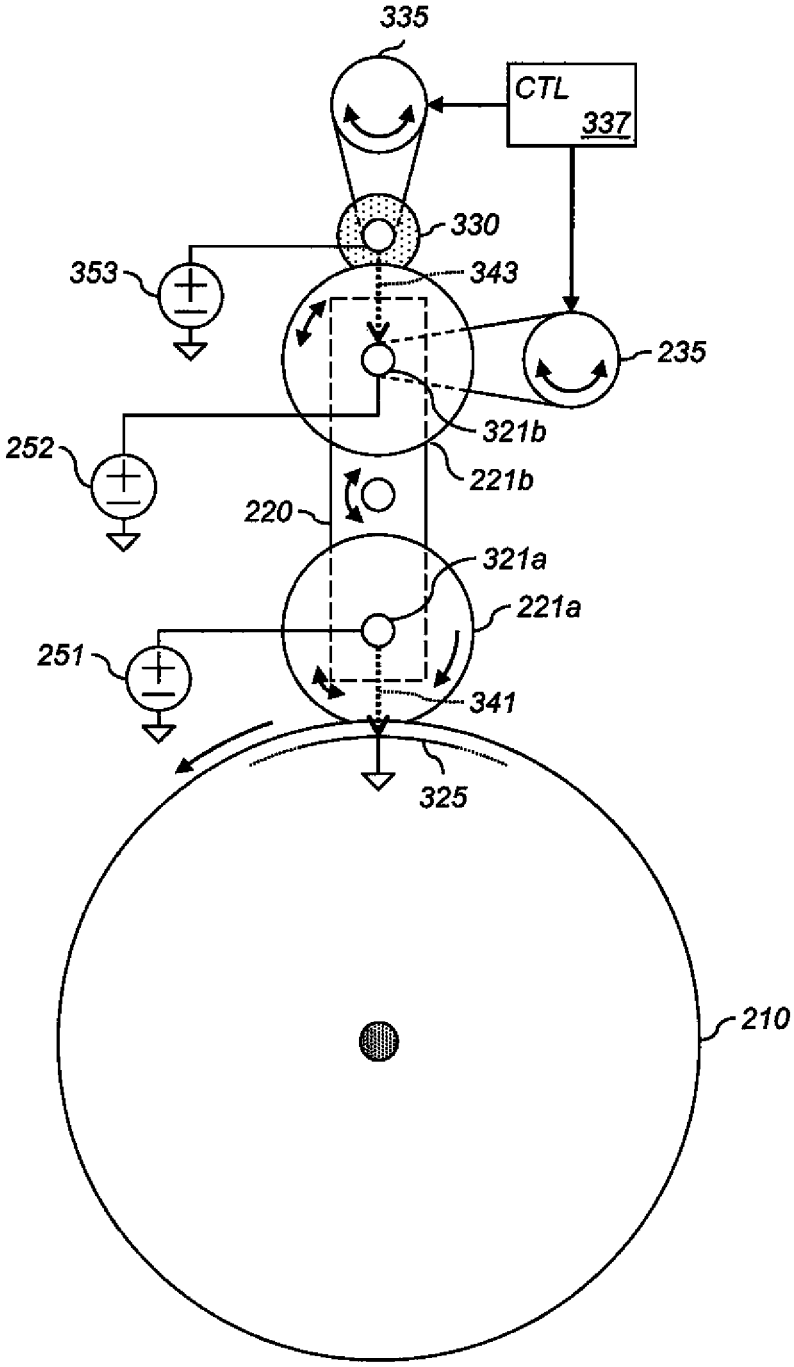

FIG. 3 shows components of an EP printer according to various embodiments. Rotatable member 210, carriage 220, chargers 221*a*, 221*b*, charger drive 235, and bias sources 251, 252 are as shown in FIG. 2.

In these embodiments, cleaner 330 is an electrically-conductive rotatable brush cleaner. Cleaner drive 335 is adapted to rotate brush cleaner 330. Third bias source 353 applies a third bias to brush cleaner 330, either through a conductive axle or hub (as shown), or through an electrode (not shown) contacting or near brush cleaner 330. In these embodiments, bias sources 251, 252 apply voltage to respective hubs 321*a*, 321*b* (or axles) of chargers 221*a*, 221*b*.

In various embodiments, the surface of rotatable member 210 is charged with respect to bias plane 325. For example, bias plane 325 can be the conductive layer of a photoreceptor 25, as discussed above. In the example shown, bias plane 325 is grounded.

In various embodiments, the difference between the second and third biases has opposite sign to the first bias. In some of these embodiments, the first bias from bias source 251 is positive with respect to the potential of bias plane 325, as shown by electric field line 341. The second bias, from bias source 252, is less than the third bias, from bias source 353, as shown by electric field line 343. In a specific example, the first bias is +300 V, so the E-field points out of charger 221*a* toward grounded bias plane 325. The second bias is −100 V and the third bias is +700V. The difference between the second and third biases is thus −800V, and the E-field points in to charger 221*b*. As discussed above, changing the direction of the E-field can improve the lifetime of ionic rollers and other rollers containing ions, ionic molecules, or other charge-carrying particles throughout the roller.

In various embodiments, the third bias is ground (i.e., brush cleaner 330 is grounded through a finite impedance, preferably <1 kΩ. In various embodiments, the magnitude (disregarding sign) of the difference between the second bias and the third bias is less than or equal to 1 kV. This permits effective cleaning and reduces the probability of electrical discharge, e.g., Paschen discharge or arcing. In various embodiments, the difference between the second and third biases is positive, and the potential of first bias source 251 with respect to bias plane 325 is negative.

In various embodiments, an electrophotographic printer includes rotatable member 210 (FIG. 2), carriage 220, and rotatable charger 221*a* mounted on the carriage and adapted to selectively impart charge to a charge-bearing layer of rotatable member 210. Rotatable brush brush cleaner 330 is adapted to selectively remove contaminants from the surface of charger 221*a*. Carriage drive 225 (FIG. 2) is adapted to move carriage 220 to bring charger 221*a* into contact with rotatable member 210 in a first position (shown) of carriage 220, and to bring charger 221*a* into operative arrangement with brush cleaner 330 in a second position (not shown) of carriage 220. Cleaner drive 335 is adapted to selectively rotate brush cleaner 330 in operative arrangement with charger 221*a*. Charger drive 235 is adapted to selectively rotate charger 221*a* in operative arrangement with brush cleaner 330. Controller 337 is adapted to cause cleaner drive 335 to rotate the brush cleaner 330, and to cause charger drive 235 to rotate charger 221*a*, so that the relative angular velocity of brush cleaner 330 with respect to charger 221*a* in operative arrangement therewith is higher in magnitude than a selected angular velocity. Controller 337 also causes rotatable member 210 to rotate charger 221*a* in contact therewith at the selected angular velocity (i.e., that fast, although the directions of rotations of the various components can be the same or different). "Relative angular velocity" means the angular velocity of brush cleaner 330 observed from a point on the surface of charger 221*a*. If brush cleaner 330 is rotating clockwise at 1 rad/s ($\omega_{330}$=+1 rad/s) and charger 221*a* is rotating clockwise at 1 rad/s ($\omega_{222a}$=−1 rad/s), the relative angular velocity of brush cleaner 330 with respect to charger 221*a* is $\omega_{330}-\omega_{221a}$=+2 rad/s. Cleaning at a higher speed than charging permits cleaning more effectively and in a shorter time.

Figure 4:
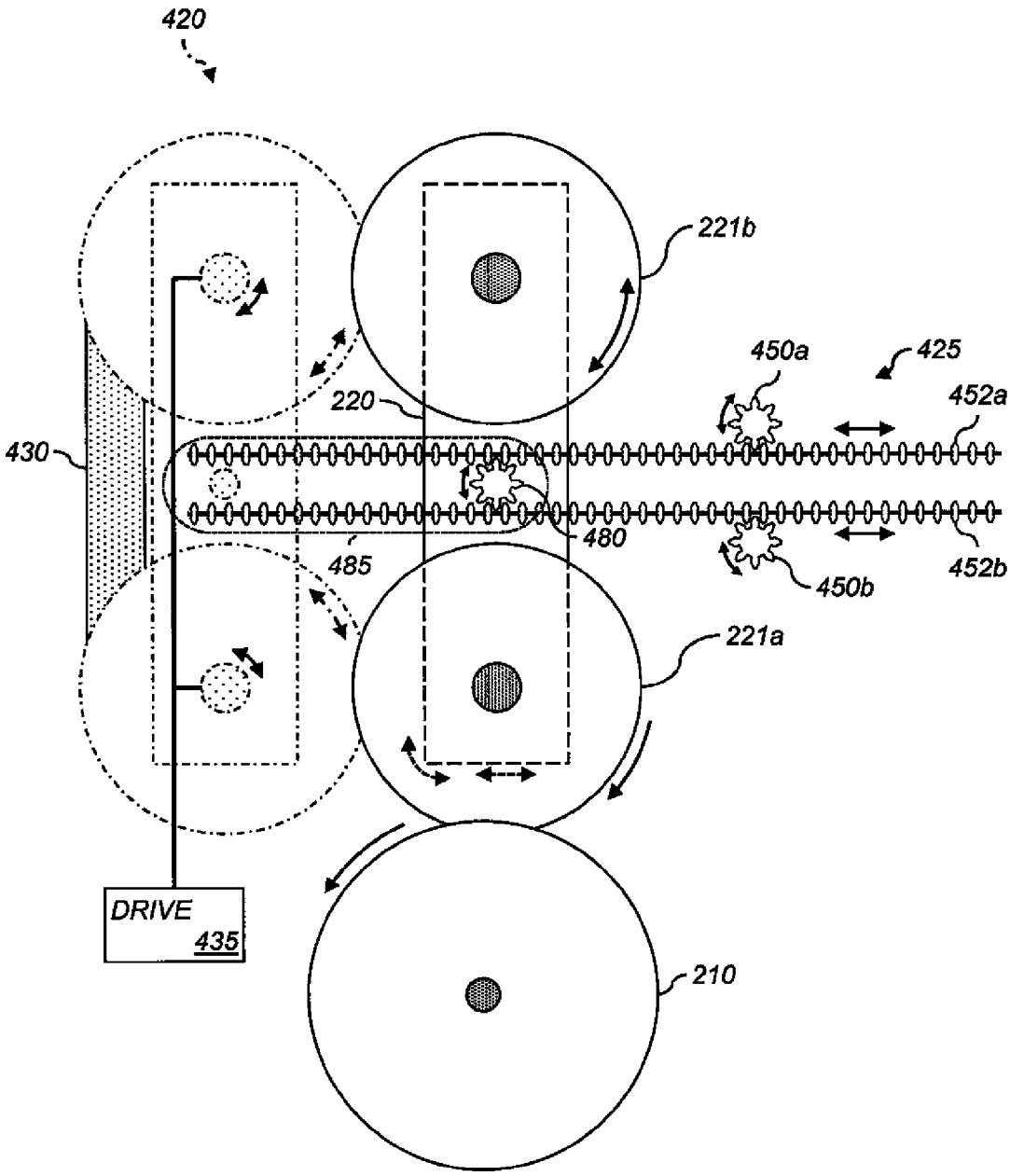

FIG. 4 shows components of an EP printer according to various embodiments. In these embodiments, chargers 221*a*, 221*b* can both be disengaged from rotatable member 210 for cleaning. Rotatable member 210, carriage 220, and chargers 221*a*, 221*b* are as shown in FIG. 2. Carriage 220 is rotatable around an axis (axis 222, FIG. 2).

Carriage drive 425 is adapted to move carriage 220 between first and second positions. In the first position, the first or second charger 221*a*, 221*b* is brought into contact with rotatable member 210. In the second position of carriage 220, shown in dash-dot lines as cleaning position 420, first and second chargers 221*a*, 221*b* are brought into operative arrangement with cleaner 430. Cleaner 430 can include separate cleaning elements for each charger 221*a*, 221*b*, or a common cleaning element (e.g., a fabric belt) for both chargers 221*a*, 221*b*. Cleaner 430 can include any of the elements described above for cleaner 230 (FIG. 2) or brush cleaner 330 (FIG. 3).

In various embodiments, carriage 220 includes carriage pinion 480 mounted on or near its axis 222 (FIG. 2). Carriage pinion 480 engages drive racks 452*a*, 452*b* at different points around the circumference of carriage pinion 480, e.g., at diametrically-opposed points. Drive racks 452*a*, 452*b* are moved by drive pinions 450*a*, 450*b*, respectively. Drive pinions 450*a*, 450*b* are operated by motors or actuators (not shown) controlled by a controller (e.g., controller 337, FIG. 3). In the example shown in FIG. 4, the respective speeds of rotation of drive pinions 450*a*, 450*b* when in operation are constant and equal. When drive pinion 450*a* rotates clockwise and drive pinion 450*b* rotates counter-clockwise, carriage pinion 480 (hence carriage 220) will be moved right-to-left (in this view) along carriage channel 485 towards cleaner 430. When drive pinion 450*a* rotates counter-clockwise and drive pinion 450*b* rotates clockwise, carriage pinion 480 will be moved left-to-right away from cleaner 430. When drive pinions 450*a*, 450*b* are rotated in the same direction, carriage 220 is rotated in the opposite direction. In other embodiments, drive pinions 450*a*, 450*b* are rotated at different speeds to translate and rotate carriage 220 simultaneously. In other embodiments, carriage drive 425 includes a linear stage for translating carriage 220 and a servomotor for rotating carriage 220. Carriage channel 485 is a slot or other structure adapted to permit carriage pinion 480 to move between cleaner 430 and rotatable member 210 while maintaining engagement between carriage pinion 480 and drive racks 452*a*, 452*b*.

Drive 435, represented graphically here using heavy lines, selectively rotates each charger 221*a*, 221*b* in operative arrangement with cleaner 430, i.e., while carriage 220 is in its second position. Each charger 221*a*, 221*b* is rotated at a speed greater than a selected speed or with a torque greater than a selected torque. This provides improved cleaning, as discussed above. Also as discussed above, rotatable member 210 rotates the rotatable charger in contact therewith (e.g., charger 221*a*) at the selected speed and torque. Drive 435 can include rods, gears, or belts to transmit rotational power from a motor or servo to chargers 221*a*, 221*b* in cleaning position 420.

In various embodiments, carriage drive 425 moves carriage 220 so that only one of the first and second chargers 221*a*, 221*b* is in contact with rotatable member 210 at a time. That is, chargers 221*a*, 221*b* are not both simultaneously in mechanical contact with rotatable member 210.

In various embodiments, carriage drive 425 is further adapted to move the carriage in a particular sequence. For example, carriage drive 425 can include an FPGA, PLD, PLA, PAL, microprocessor, or PLC that controls the sequence of activation of the gear drive motors. In an embodiment, carriage drive 425 moves carriage 220 so that first charger 221*a* is in contact with rotatable member 210. Carriage 220 is then moved so that first charger 221*a* is removed from contact with rotatable member 210. Carriage 220 continues to move so that both chargers 221*a*, 221*b* are in operative arrangement with the cleaner. After cleaning, carriage drive 425 moves carriage 220 to disengage both chargers 221*a*, 221*b* from cleaner 430, and then to engage second charger 221*b* in contact with rotatable member 210.

Figure 5:
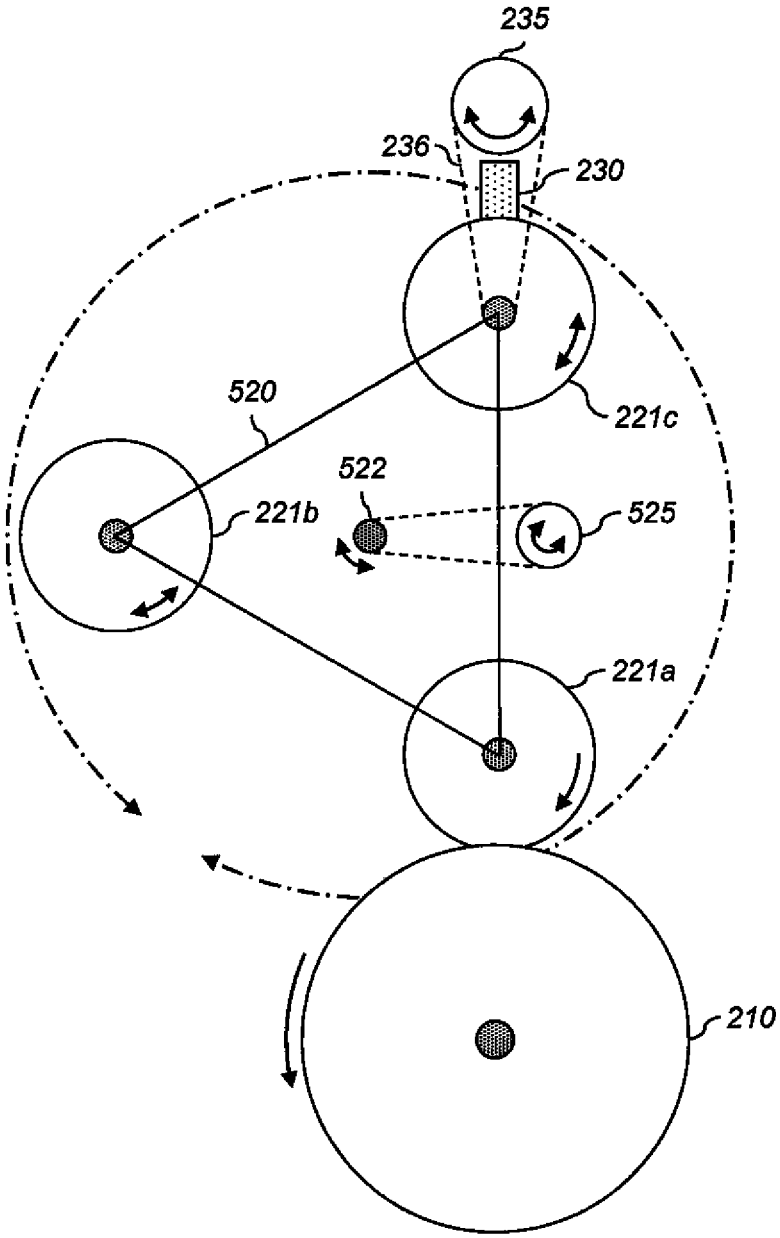

FIG. 5 shows components of an EP printer according to various embodiments. In these embodiments, chargers 221*a*, 221*b*, 221*c* can be engaged and disengaged from rotatable member 210 and cleaner 230 in a more independent way. Rotatable member 210, chargers 221*a* and 221*b*, cleaner 230, charger drive 235, and belt 236 are as shown in FIG. 2. Charger 221*c* is as chargers 221*a*, 221*b*.

Chargers 221*a*, 221*b*, and optionally 221*c* are arranged on carriage 520 in a configuration other than one in which two chargers are diametrically opposed around axis 222 (FIG. 2) of carriage 220 (FIG. 2). In this example, carriage 520 is an equilateral triangle with a charger mounted at two or three of its points. Carriage 520 rotates around axis 522.

Carriage drive 525 is adapted to selectively rotate carriage 520 into first and second positions. In the first position (shown in FIG. 5), first charger 221*a* is brought into contact with rotatable member 210. Second charger 221*b* is brought out of operative arrangement with cleaner 230, so is not in use for charging and is not being cleaned. In the second position, first charger 221*a* is brought out of contact with rotatable member 210. Second charger 221*b* is into operative arrangement with the cleaner in a second position of the carriage. FIG. 5 shows an example of the first position; carriage drive 525 rotates carriage 520 clockwise 120° to move it into the second position.

Charger drive 235 uses belt 236 to selectively rotate charger 221*a* in operative arrangement with cleaner 230 at a speed greater than a selected speed or with a respective torque greater than a selected torque. Rotatable member 210 rotates rotatable charger 221*a* in contact therewith at the selected speed and torque.

In various embodiments, third rotatable charger 221*c* is mounted on carriage 520 and operative to selectively impart charge to a charge-bearing layer of the rotatable member. In this example, carriage drive 525 moves carriage 520 between three positions. In each position, one of the three chargers 221*a*, 221*b*, 221*c* is in contact with rotatable member 210, another one of the three chargers 221*a*, 221*b*, 221*c* is engaged with cleaner 230, and the third of the three chargers 221*a*, 221*b*, 221*c* is idle. This can be extended to any number ≧3 of chargers.

In other embodiments, the carriage is movable. The cleaner is adapted to selectively remove contaminants from the surface of the charger, and can include a fixed compliant/rigid blade, a fur brush (stationary or rotating), a foam roller, or a stationary foam pad.

The carriage drive is adapted to move the carriage to bring the charger into contact with the rotatable member in a first position of the carriage, and to bring the charger into operative arrangement with the cleaner in a second position of the carriage. This is effective even if only one charger is present on the carriage. A charger drive selectively rotates the charger at a speed greater than a selected speed or with a torque greater than a selected torque while the charger is in operative arrangement with the cleaner. The rotatable member rotates the rotatable charger in contact therewith at the selected speed with the selected torque.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* voltage source
22 exposure subsystem
23 toning station
23*a* voltage source
25 photoreceptor
25*a* voltage source
31, 32, 33, 34, 35, 36 printing module
38 print image
39 fused image
40 supply unit
42, 42A, 42B receiver
50 transfer subsystem
60 fuser
64 fusing roller
66 pressure roller
68 fusing nip
69 release fluid application substation
70 output tray
81 finisher
86 transport web
99 cleaning station
100 logic and control unit (LCU)
100 printer
210 rotatable member
220 carriage
221*a*, 221*b*, 221*c* charger
222 axis
225 carriage drive
226 belt
230 cleaner
235 charger drive
236 belt
241, 242 distance
251, 252 bias source
321*a*, 321*b* hub
325 bias plane
330 brush cleaner
335 cleaner drive
337 controller
341, 343 electric field line
353 bias source
420 cleaning position
425 carriage drive
430 cleaner
435 drive
450*a*, 450*b* drive pinion
452*a*, 452*b* drive rack
480 carriage pinion
485 carriage channel

520 carriage
522 axis
525 carriage drive

The invention claimed is:

1. An electrophotographic printer, comprising:
a. a rotatable member;
b. a carriage rotatable around an axis;
c. first and second rotatable chargers mounted on the carriage, each adapted to selectively impart charge to a charge-bearing layer of the rotatable member;
d. a cleaner adapted to selectively remove contaminants from the surface of either of the chargers;
e. a carriage drive adapted to rotate the carriage to bring the first charger into contact with the rotatable member and the second charger into operative arrangement with the cleaner in a first position of the carriage, and to bring the second charger into contact with the rotatable member and the first charger into operative arrangement with the cleaner in a second position of the carriage; and
f. a charger drive adapted to selectively rotate the charger in operative arrangement with the cleaner at a speed greater than a selected speed or with a torque greater than a selected torque;
g. wherein the rotatable member rotates the rotatable charger in contact therewith at the selected speed with the selected torque.

2. The printer according to claim 1, wherein the two chargers are mounted on the carriage at the same distance from the axis thereof.

3. The printer according to claim 1, further including first and second bias sources for selectively providing respective biases, wherein the first bias source provides the first bias to the charger in contact with the rotatable member, and the second bias source provides the second bias to the charger in operative association with the cleaner.

4. The printer according to claim 3, wherein the cleaner is an electrically-conductive rotatable brush cleaner, the printer further including a cleaner drive for rotating the brush cleaner and a third bias source for applying a third bias to the brush cleaner, wherein the difference between the second and third biases has opposite sign to the first bias.

5. The printer according to claim 4, wherein the third bias is ground.

6. The printer according to claim 4, wherein the magnitude of the difference between the second bias and the third bias is less than or equal to 1 kV.

7. The printer according to claim 1, wherein the magnitude of the first bias is less than or equal to 1 kV.

8. An electrophotographic printer, comprising:
a. a rotatable member;
b. a carriage rotatable around an axis;
c. first and second rotatable chargers mounted on the carriage, each operative to selectively impart charge to a charge-bearing layer of the rotatable member;
d. a cleaner adapted to selectively remove contaminants from the surface of one of the chargers;
e. a carriage drive adapted to move the carriage to bring the first or second charger into contact with the rotatable member in a first position of the carriage, and the first and second chargers into operative arrangement with the cleaner in a second position of the carriage; and
f. a drive adapted to selectively rotate each charger in operative arrangement with the cleaner at a speed greater than a selected speed or with a torque greater than a selected torque;
g. wherein the rotatable member rotates the rotatable charger in contact therewith at the selected speed and torque.

9. The printer according to claim 8, wherein the carriage drive moves the carriage so that only one of the first and second chargers is in contact with the rotatable member at a time.

10. The printer according to claim 8, wherein the carriage drive is further adapted to move the carriage so that the first charger is in contact with the rotatable member, then both chargers are in operative arrangement with the cleaner, then the second charger is in contact with the rotatable member.

11. An electrophotographic printer, comprising:
a. a rotatable member;
b. a carriage rotatable around an axis;
c. first and second rotatable chargers mounted on the carriage, each operative to selectively impart charge to a charge-bearing layer of the rotatable member;
d. a cleaner adapted to selectively remove contaminants from the surface of one of the chargers;
e. a carriage drive adapted to rotate the carriage to bring the first charger into contact with the rotatable member and the second charger out of operative arrangement with the cleaner in a first position of the carriage, and the first charger out of contact with the rotatable member and the second charger into operative arrangement with the cleaner in a second position of the carriage;
f. a drive adapted to selectively rotate the charger in operative arrangement with the cleaner at a speed greater than a selected speed or with a respective torque greater than a selected torque; and
g. wherein the rotatable member rotates the rotatable charger in contact therewith at the selected speed and torque.

12. The printer according to claim 11, further including a third rotatable charger mounted on the carriage and operative to selectively impart charge to a charge-bearing layer of the rotatable member.

13. An electrophotographic printer, comprising:
a. a rotatable member;
b. a carriage;
c. a rotatable charger mounted on the carriage and adapted to selectively impart charge to a charge-bearing layer of the rotatable member;
d. a cleaner adapted to selectively remove contaminants from the surface of the charger;
e. a carriage drive adapted to move the carriage to bring the charger into contact with the rotatable member in a first position of the carriage, and to bring the charger into operative arrangement with the cleaner in a second position of the carriage;
f. a charger drive adapted to selectively rotate the charger at a speed greater than a selected speed or with a torque greater than a selected torque while the charger is in operative arrangement with the cleaner; and
g. wherein the rotatable member rotates the rotatable charger in contact therewith at the selected speed with the selected torque.

14. An electrophotographic printer, comprising:
a. a rotatable member;
b. a carriage;
c. a rotatable charger mounted on the carriage and adapted to selectively impart charge to a charge-bearing layer of the rotatable member;
d. a rotatable cleaner adapted to selectively remove contaminants from the surface of the charger;

e. a carriage drive adapted to move the carriage to bring the charger into contact with the rotatable member in a first position of the carriage, and to bring the charger into operative arrangement with the cleaner in a second position of the carriage;

f. a cleaner drive adapted to selectively rotate the cleaner in operative arrangement with the charger;

g. a charger drive adapted to selectively rotate the charger in operative arrangement with the cleaner; and h. a controller adapted to cause the cleaner drive to rotate the cleaner, and to cause the charger drive to rotate the charger, so that the relative angular velocity of the cleaner with respect to the charger in operative arrangement with the cleaner is higher in magnitude than a selected angular velocity, and for causing the rotatable member to rotate the charger in contact therewith at the selected angular velocity.

* * * * *